US006637545B1

(12) United States Patent
Jonsson et al.

(10) Patent No.: US 6,637,545 B1
(45) Date of Patent: Oct. 28, 2003

(54) SILENCER

(76) Inventors: Erik Jonsson, Danavagen 4, Lidingo (SE), SE-18131; Mikael Persson, Ryattarvagen 9, Sodertalje (SE), SE-15159

( * ) Notice: Subject to any disclaimer, the term of this patent is extended or adjusted under 35 U.S.C. 154(b) by 35 days.

(21) Appl. No.: 10/129,001

(22) PCT Filed: Oct. 18, 2000

(86) PCT No.: PCT/SE00/02017

§ 371 (c)(1),
(2), (4) Date: Jul. 1, 2002

(87) PCT Pub. No.: WO01/33049

PCT Pub. Date: May 10, 2001

(30) Foreign Application Priority Data

Nov. 5, 1999 (SE) ..... 9904036

(51) Int. Cl.[7] ..... F01N 1/18; F01N 1/00; F02B 27/02

(52) U.S. Cl. ..... 181/237; 181/250; 181/254; 181/226; 60/312

(58) Field of Search ..... 181/250, 254, 181/226, 237, 264, 266, 277, 281; 60/280, 281, 291, 292, 312

(56) References Cited

U.S. PATENT DOCUMENTS

| | | | | |
|---|---|---|---|---|
| 2,072,372 A | | 2/1937 | Kingsley | |
| 3,874,569 A | * | 4/1975 | Fossett et al. | 222/508 |
| 4,926,636 A | * | 5/1990 | Tadokoro et al. | 60/312 |
| 5,692,374 A | * | 12/1997 | Seki et al. | 60/312 |

FOREIGN PATENT DOCUMENTS

| | | | | |
|---|---|---|---|---|
| EP | 0733785 | | 9/1996 | |
| EP | 0771939 | | 5/1997 | |
| JP | 57102508 A | * | 6/1982 | F01N/1/08 |
| WO | 9925962 | | 5/1999 | |

* cited by examiner

*Primary Examiner*—Robert E. Nappi
*Assistant Examiner*—Patrick Miller
(74) *Attorney, Agent, or Firm*—Dowell & Dowell, P.C.

(57) ABSTRACT

A device for silencing a flowing gas which includes a valve housing in which a valve is mounted. A separate pressure regulator is provided which is in communication with the flowing gas and which is responsive to gas pressure to thereby influence movement of a mechanical actuating device which controls movement of the valve such that the valve may be opened at least two different rates dependent upon the pressure of the flowing gas.

6 Claims, 4 Drawing Sheets

SILENCER

BACKGROUND OF THE INVENTION

1. Field of the Invention

The present invention relates to a silencer device for silencing of a flowing gas, comprising a valve which is arranged in a valve housing through which the gas is flowing.

2. Description of the Related Art

Especially in the car industry, new ways of silencing sound in, for example, exhaust systems are investigated. One method is to deliberately introduce a disturbance in the flowing gas, which causes a change in the characteristics of the sound in a positive way. A valve is arranged in the flowing gas to increase the back pressure in the exhaust system and it is controlled automatically by the pressure of the gas.

Since the flow of the exhaust gases change characteristics at a certain exhaust gas pressure, depending on motor type, it is desirable that the valve opens at different velocities at different exhaust gas pressures. At a certain pressure it is desirable that, from a sound silencing point of view, to almost momentary open the valve in full. A choke at a high pressure and large flow rates implies large losses of effect for the motor, which of course is not desirable.

Previously known valves open at a constant or inverse exponential velocity, which means that the valve opens too quickly in the beginning, whereby too little silencing occur with subsequent effect losses.

An attempt to solve this problem is shown and described in the Swedish patent application 9704221-2. Therein, a partial flow of the exhaust gases is lead to valve actuating means, which controls the opening of a valve, which is arranged in the exhaust gas flow through a silencer. The valve actuating means comprises two membranes and two different springs and a piston rod. At lower pressures the piston rod is drawn, against the biasing force of the large spring, which piston rod is connected to the valve, into the valve actuating means so that the valve is opened. When the pressure passes a predetermined valve a passage is opened, against the biasing force of the small spring between a first and a third space so that both of the membranes are influenced at the same time, whereby the piston rod is drawn into the valve actuating means quicker and the valve opens quicker.

This solution is complicated and not reliable. In order to function a most accurate manufacturing is needed with components having very small tolerances. This makes the manufacturing and also the maintenance expensive. Another essential problem with this solution is that it is impossible to design the actuating means so that it will open quickly enough after that the predetermined pressure has been achieved.

SUMMARY OF THE INVENTION

The object of the present invention is to provide a silencer device which has a simple design, is inexpensive to manufacture, reliable in use and which has actuating means, which opens the valve nearly momentary when a predetermined pressure is achieved.

These objects are met according to the invention by a silencer device according to the preamble, which is characterised in that the silencer device also comprises a separate pressure regulator, which is provided outside of the valve housing, to which pressure regulator a conduct from the valve housing is leading, which leads a portion of the flowing gas to the pressure regulator, whereby, the pressure force of the gas is convertible in the pressure regulator to a displacement motion for actuating a separate mechanical actuating means, whereby the valve (1) is openable in at least two different predetermined opening velocities, which opening velocities depend of the pressure of the gas.

Further, the actuating means gives an increased ratio after that a predetermined gas pressure has been achieved, whereby the opening velocity increases.

According to a first embodiment of the actuating means, this shows a number of hinged, rod like means.

Preferably, the rod like means move along a groove, which comprises at least two differently angled guide surfaces, each guide surface corresponds a certain opening velocity.

According to a second embodiment of the actuating means, the valve is actuatable by the actuating means by a first length of a momentum arm from an extended rotational axis of the valve whereby after that a predetermined gas pressure is achieved the valve is actuatable by the second, shorter, momentum arm from the rotational axis of the valve.

According to a third embodiment of the actuating means this shows at least two differently sized gear wheels fixedly attached to an extended rotational axle of the valve for successive co-operation with a gear rack each, which are actuatable by the pressure regulator.

The valve may, for example, be rotatably arranged around a rotational axis in the valve housing or be slided into the valve housing as a guillotine. Of course, also many other types of valves may be used.

There is a lot of advantages with the silencer device according to the invention. For example the device is small and light weighted, especially compared to conventional silencers. Another advantage is that you easily may change the ratio, i.e. the opening velocity of the valve, so that the device easily may be adapted to different motors. Additionally, it is easily to provide more ratio steps, if desired.

The silencer device according to the invention may be used in many different applications, such as exhaust systems and air intake systems for motors or other systems with flowing gas that is desirable to silence.

BRIEF DESCRIPTION OF THE DRAWINGS

Preferred embodiment of the invention will now be illustrated as examples and with reference to the attached drawings.

DETAILED DESCRIPTION OF PREFERRED EMBODIMENTS

Figure 1:
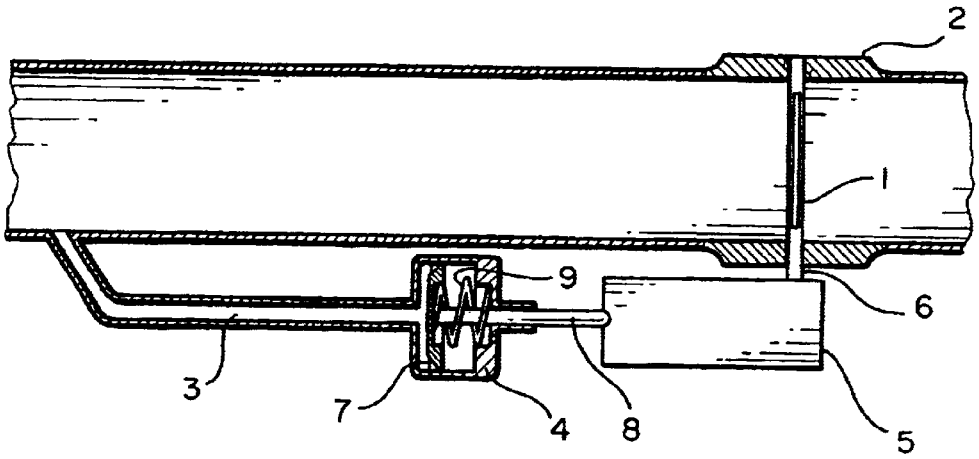
FIG. 1 illustrates schematically the whole silencer device.

In FIG. 1 a silencer device according to the present invention is illustrated, which comprises a valve 1, which is arranged in a valve housing 2 through which the gas is flowing. A conduit 3 is lead from the valve housing 2, through which conduit 3 a portion of the gas flows, to a pressure regulator 4. The pressure regulator 4 acts on actuating means 5, which in turn regulates the opening of the valve 1.

The valve 1 has an area, which is smaller than the cross section area of the valve housing so that gas always may pass even when the valve is in a closed position, i.e. has its full area orthogonally to the gas flow, and has a rotational axle 6 which is rotatably arranged in the valve housing 2.

The pressure regulator 4 comprises a membrane 7, a piston rod 8 and a pressure spring 9 and converts the pressure of the gas on the membrane 7 and the pressure spring 9 to a mechanical force that displaces the piston rod 8 outwards. In case of lowered pressure the pressure spring 9 returns so that the piston rod is drawn into the pressure regulator 4 again. The piston rod 8 acts on the actuating means 5.

Figure 2:
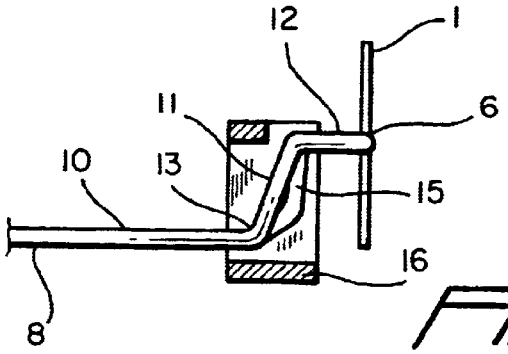
FIG. 2 illustrates a side view of a first embodiment of an actuating means of the device.
Figure 3:
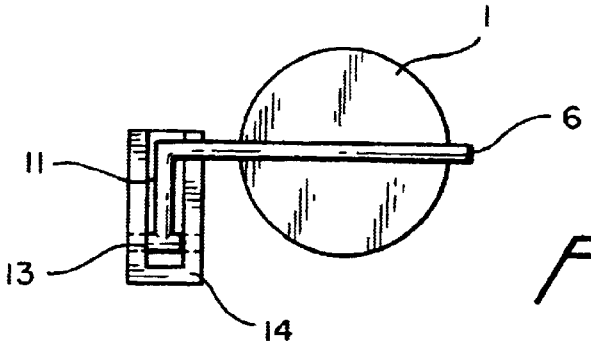
FIG. 3 illustrates a front view of the first embodiment of the actuating means.

The actuating means 5 may be designed in many different ways. Three embodiments will be described hereafter. FIG. 2 illustrates a first embodiment of the actuating means 5 as seen from the side. The actuating means 5 comprises three rods, which are hingably attached to the ends of each other. A first rod 10 is hingably attached to the piston rod 8 of the pressure regulator 4 with its first end and with its second end to a first end of a second rod 11. The second rod 11 is in turn hingably attached with its second end to a first end of a third rod 12. The third rod 12 is fixedly attached, orthogonally to, with its second end to the rotational axle 6 of the valve 1, see FIG. 3.

Between the second end of the first rod 10 and the first end of the second rod 11 a hinge 13 is provided. This hinge 13 has portions that protrude substantially orthogonally to the lengthwise extension of the rods 10, 11, see FIG. 3. A housing is fixedly attached to the exterior of the valve housing 2. The rods 10, 11, 12 lead through the housing 14. In the side walls of the housing 14, grooves 15 comprising guide surfaces are arranged in which the protruding portions of the hinge 13 may move. The grooves 15 are divided into two straight portions, which are angled to each other.

Figure 4:
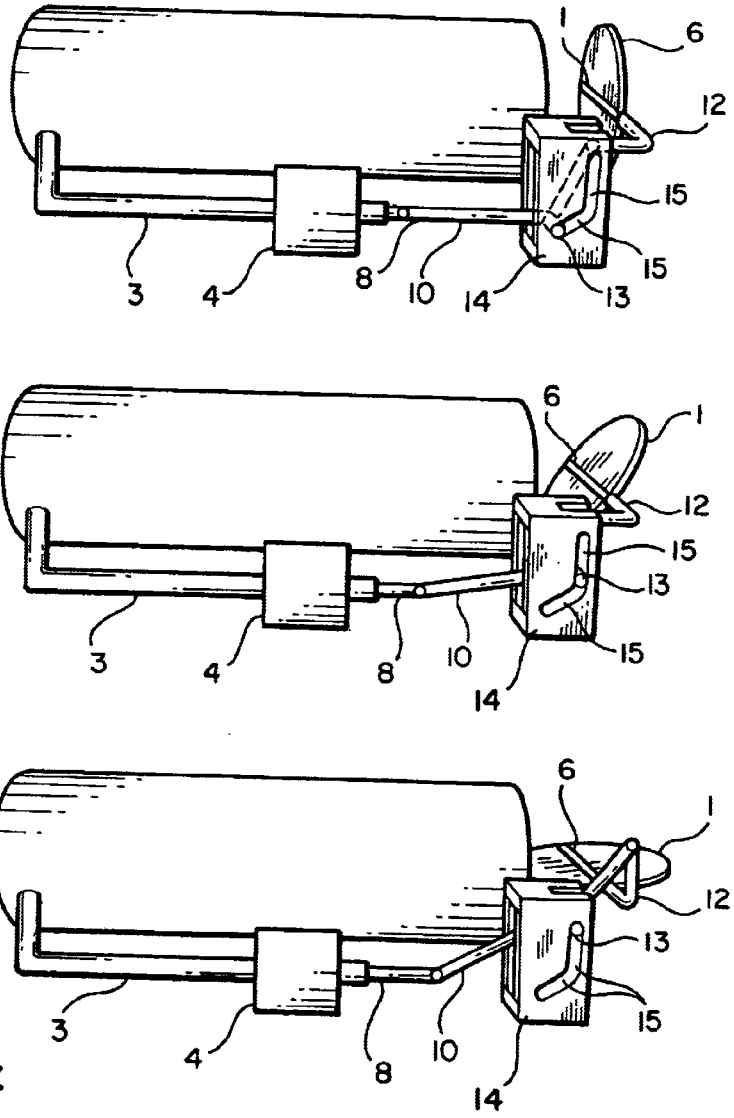
FIG. 4 illustrates a side view of a valve opening series comprising the actuating means of FIGS. 2 and 3.

When the gas pressure increases the piston rod 8 of the pressure regulator 4 is displaced outwards, see FIG. 4, and thereby the first rod 10 is displaced so that the protruding portions of the hinge 13 slides along the first portions of the grooves, whereby also the second and third rod 11, 12 are influenced. The third rod 12 turns the valve 1, i.e. opens it, due to the fixed attachment between the third rod 12 and the rotational axle 6. This is carried out in a uniform velocity as long as the protruding portions of the hinge 13 slides along the first portions of the grooves 15.

When a certain pressure has been reached and the valve 1 has opened a certain percentage, the protruding portions of the hinge 13 has reached the transition between the first and the second portions of the grooves 15, whereupon the ratio is changes and the valve 13 opened with high velocity when the protruding portions of the hinge 13 slides along the steep second portions of the grooves 15. The valve 1 then opens almost momentary.

Preferably there are grooves 15 provided on both of the sides of the rods 10, 11, 13 so that a stable movement may occur along the grooves 15 but of course it is possible to have only one groove. By changing the length of the rods and/or the angle of the grooves the ratio will change and thereby the opening velocity of the valve 1. If so desired, also further ratio steps may be inserted by inserting further angled portions of the groove.

Figure 5:
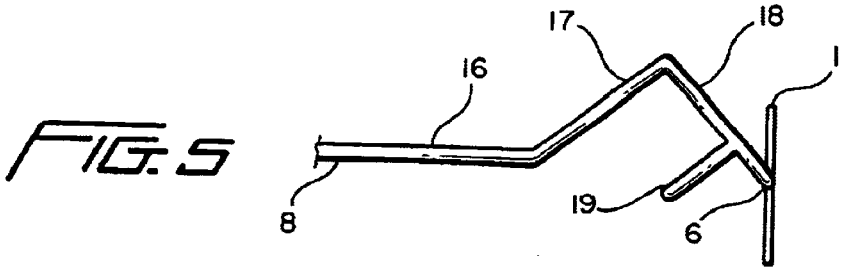
FIG. 5 illustrates a second embodiment of the actuating means.

In FIG. 5 a second embodiment of the actuating means 5 is illustrated, which comprises four rods which move in a calculated path when acted on by the piston rod 8 of the pressure regulator 4. A first rod 16 is hingably attached at its first end to the piston rod 8 and at its second end to a first end of a second rod 17. The second rod 17 is at its second end hingably attached to a first end of a third rod 18. The third rod is fixedly attached, orthogonally to, at its second end to the rotational axle 6 of the valve 1. A fourth rod 19 is in one of its ends fixedly attached orthogonally outwards from the third rod 18 and is in the same plane as the other rods 16, 17, 18.

Figure 6:
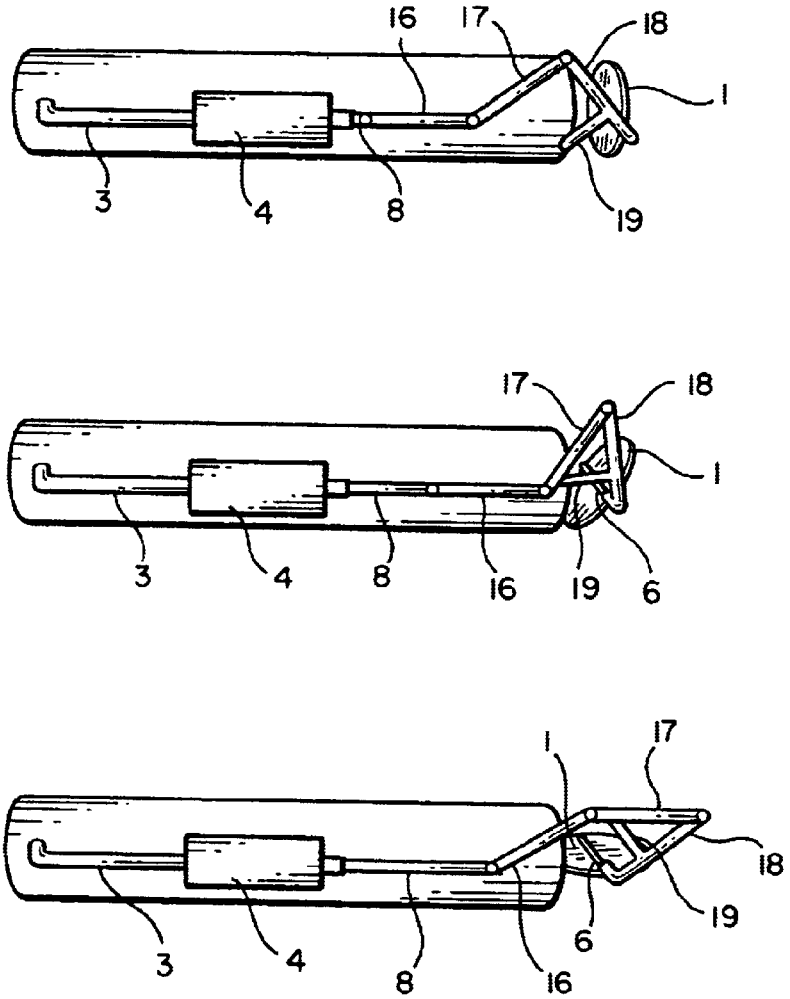
FIG. 6 illustrates a side view of a valve opening series comprising the actuating means of FIG. 5.

When the piston rod 8 is displaced out of the pressure regulator 4, see FIG. 6, the first rod 16 is displaced and the second rod 17 is inclined, which in turn influence the third rod 18 so that the valve 1 turns, i.e. opens. The increase in pressure displaces the piston rod 8, which in turn influence the first to the third rod at a certain ratio, which gives a certain opening velocity.

When the pressure exceeds a certain value and the valve 1 has been opened to a certain percentage, the ratio is changed due to the fact that the free end of the fourth rod 19 comes into contact with the second rod 17. Then the influence of the actuating means 5 on the valve 1 is transmitted by a shorter momentum arm, which causes the valve 1 to open much faster, preferably almost momentary.

Depending on how the lengths of the rods are designed and where the attachments are positioned it is possible to achieve desired ratios. Preferably, the second rod 17 is planar at the surface where the fourth rod 19 comes into contact, but the second rod 17 may instead have a square or rectangular cross-section.

Figure 7:
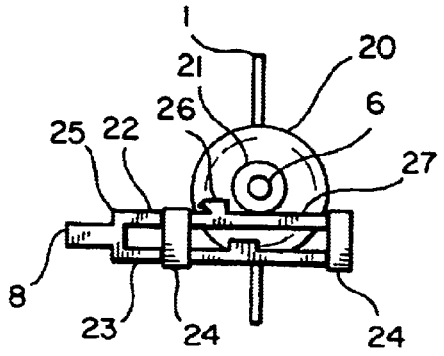
FIG. 7 illustrates a side view of a third embodiment of the actuating means.

In FIG. 7 a third embodiment of the actuating means 5 is shown from the side, which comprises a large 20 and a small 21 gear wheel, an upper 22 and a lower 23 slide rod and two attachments 24. The attachments 24 are arranged on the exterior of the valve housing 2 and are provided with recesses in which the two slide rods 22, 23 may slide at the same time as they are supported by the attachments 24. The piston rod 8 from the pressure regulator 4 is fixedly attached to a slide rod unifying means 25 so that both the slide rods 22, 23 are influenced, at the same time, by the piston rod 8 at pressure changes and slides in the attachments 24.

Figure 8:
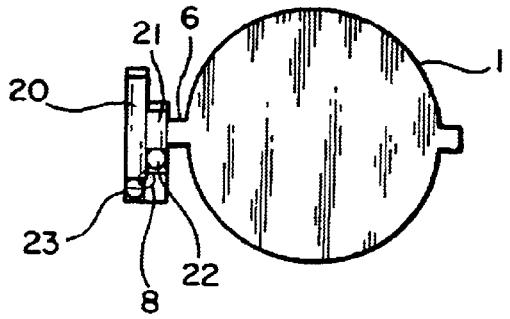
FIG. 8 illustrates a front view of the third embodiment.

On the upper slide rod 22 there is a gear rack portion 26, so that the slide rod partially functions as a gear rack, which may co-operate with the small gear wheel 21 and on the lower slide rod 23 there is a gear rack portion 27, so that the slide rod partially functions as a gear rack, which may co-operate with the large gear wheel 20. The large and small gear wheel 20, 21 are fixedly attached to the rotational axle 6 of the valve 1, see FIG. 8. The slide rods 22, 23 are arranged slightly displaced sideways so that they are positioned under each gear wheel 21, 20, respectively.

Figure 9:
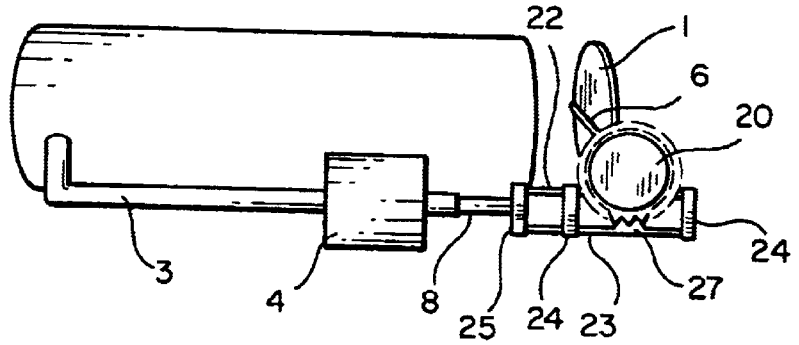
FIG. 9 illustrates a side view of a valve opening series comprising the actuating means of FIGS. 7 and 8.
Figure 9:
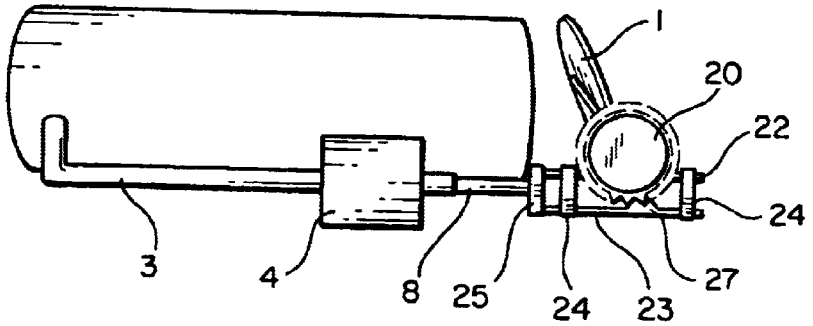
Figure 9:
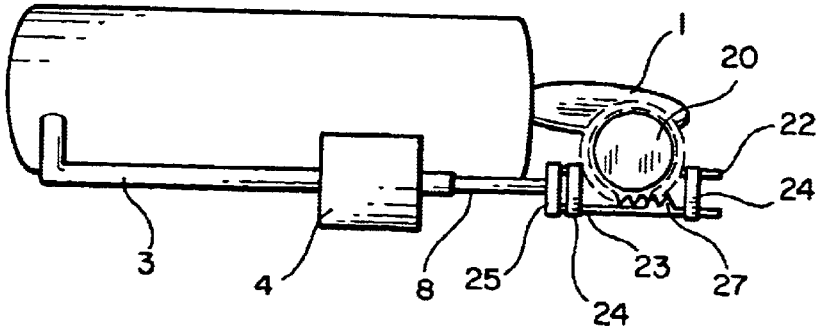

When the gas pressure increases the large gear wheel meshes with the gear rack portion 27 at the lower slide rod 23, see FIG. 9, so that the valve 1 opens with a low velocity. When a predetermined pressure has been reached and the valve 1 has opened a predetermined percentage, the slide rods 22, 23 have been displaced so much that the large gear wheel 20 loses contact with the gear rack portion 27 on the lower slide rod 23 at the same time as the small gear wheel 21 meshes with the gear rack portion 26 of the upper slide rod 22. Since the radius of the small gear wheel is smaller than the radius of the large gear wheel 20 the ratio changes so that the valve 1 opens very quickly at a pressure increase.

Also in this embodiment it is easy to simply change the ratio by changing the dimensions of the gear wheels. If further ratio steps are desired, further gear wheels with co-operating gear rack rods may be provided.

These embodiments have been shown in combination with a valve, which is rotatably arranged around a rotational axis in the valve housing. Of course, also many other types of valves may be used, for example, a valve which is slided into the valve housing as a guillotine.

What is claimed is:

1. A silencer device for silencing a flowing gas, comprising a valve (1), which is arranged in a valve housing (2) through which the gas is flowing, a separate pressure regulator (4) provided exterior of the valve housing (2), a conduit (3) for communicating gas flowing to the valve housing (2) to the pressure regulator (4) so that a portion of the gas flows to the pressure regulator, whereby a pressure force of the portion of gas is convertable in the pressure regulator (4) to a displacement motion for influencing of a separate mechanical actuating means (5), by means of a piston rod (8) which is displaceable outwards of the pressure regulator (4) for acting on the actuating means (5), which in turn makes the valve (1) openable at at least two different predetermined opening velocities and wherein the actuating means (5) has an increase ratio after each of at least one predetermined gas pressure has been reached, whereby the opening velocity of the valve (1) increases for each ratio increase.

2. The silencer device according to claim 1 wherein the actuating means (5) has at least two differently sized gear wheels (20, 21) fixedly attached to an extended rotational axle (6) of the valve (1) for successive co-operation with a gear rack rod (22, 23) each which are influenced by the pressure regulator (4).

3. The silencer device according to claim 1, wherein the actuating means (5) a number of hinged rod means (10, 11, 12, 13, 16, 17, 18, 19).

4. The silencer device according to claim 3, wherein the rod means (10, 11, 12, 13) are movable along a groove (15) which comprises at least two differently angled guide surfaces, whereby each guide surface corresponds to a different opening velocity.

5. The silencer device according to claim 3, wherein the valve (1) is influenced by the actuating means (5) by means of a first momentum arm from an extended rotational axle (6) of the valve (1) and whereby when the predetermined gas pressure has been reached, the valve (1) is influenced by the actuating means (5) by a second momentum arm, which is shorter than the first, from the rotational axle (6) of the valve (1).

6. A silencer device for silencing a gas flowing through a conduit, comprising; a valve (1), which is arranged in a valve housing (2) communicating with the conduit through which valve housing the gas is flowing, a pressure regulator (4) exterior of the valve housing (2), a tap conduit (3) for directing a portion of the gas flowing through the conduit to the pressure regulator (4), whereby pressure of the gas is convertable in the pressure regulator (4) to a displacement motion for moving a separate mechanical actuating means (5) the valve (1) being openable at at least two different opening velocities dependent on the pressure of the gas by means of the separate mechanical actuating means (5), and the actuating means (5) having an increased motion ratio after a predetermined gas pressure has been reached in the pressure regulator, whereby the opening velocity of the valve (1) increases.

* * * * *